US006354107B1

(12) United States Patent
Verducci, Sr.

(10) Patent No.: US 6,354,107 B1
(45) Date of Patent: Mar. 12, 2002

(54) ARTICLE OF JEWELRY

(75) Inventor: Henry A. Verducci, Sr., Providence, RI (US)

(73) Assignee: Verducci Creations, Inc.

( * ) Notice: Subject to any disclaimer, the term of this patent is extended or adjusted under 35 U.S.C. 154(b) by 0 days.

(21) Appl. No.: 09/328,621

(22) Filed: Jun. 9, 1999

(51) Int. Cl.[7] ..... A44C 25/00
(52) U.S. Cl. ..... 63/33; 63/12; 63/23; 428/38
(58) Field of Search ..... 428/38; 63/12, 63/13, 20, 23, 33

(56) References Cited

U.S. PATENT DOCUMENTS

| | | | | |
|---|---|---|---|---|
| 734,066 A | | 7/1903 | Heintz | |
| 1,816,915 A | | 8/1931 | Scott | |
| 2,118,468 A | | 5/1938 | Jungersen | |
| 2,841,828 A | | 7/1958 | Osborn | |
| 3,336,427 A | | 8/1967 | Hanson | |
| 4,411,855 A | * | 10/1983 | Fiebig, Jr. et al. | 264/219 |
| 4,543,803 A | | 10/1985 | Keyasko | |
| 5,172,568 A | | 12/1992 | Senanayake | |
| 5,219,630 A | * | 6/1993 | Hickman | 428/38 |
| 5,306,535 A | * | 4/1994 | Shaffer | 428/38 |
| 5,492,739 A | * | 2/1996 | Thorne et al. | 428/38 |

* cited by examiner

*Primary Examiner*—B. Dayoan
*Assistant Examiner*—Andrea Chop
(74) *Attorney, Agent, or Firm*—Salter & Michealson Salter

(57) ABSTRACT

An article of jewelry includes a first frame having a front portion and a rear portion and a second frame having a front portion and a rear portion. The first frame and the second frame cooperate to define an aperture therebetween, the aperture comprising a front portion which coincides with the front portions of the first and second frames and a rear portion which coincides with the rear portions of the first and second frames. The article further comprises a number of spokes connected between the front portion of the first frame and the front portion of the second frame, the spokes dividing the front portion of the aperture into a number of sub-apertures and a unitary core disposed within the aperture, the unitary core filling the rear portion of the aperture and the front portion of the aperture, including the sub-apertures, and encompassing all but an outer surface of the spokes, thereby giving an impression that the unitary core comprises a plurality of pieces.

4 Claims, 3 Drawing Sheets

ARTICLE OF JEWELRY

BACKGROUND OF THE INVENTION

1. Field of the Invention

The present invention relates generally to an article of jewelry and a method for making the article, and more particularly to an article of jewelry including a casting including inner and outer frames and a unitary decorative portion disposed within the casting.

2. Discussion of the Related Art

There are many different types of costume jewelry on the market today. In designing new articles of costume jewelry, a balance must be struck between the durability, visual appeal and the ultimate retail cost of an article. In the past, most articles of jewelry which fell into the less expensive range tended to suffer from a lack of durability and visual appeal.

Prior art jewelry articles have attempted to address the above-noted concerns. U.S. Pat. No. 734,066 to Heintz discloses an article of jewelry having a base and a number of separating webs which define a number of cavities therebetween. An enamel or other material is set into the cavities, thereby producing a multi-colored article. While the resulting article is visually appealing, the separate pieces of enamel may be prone to falling out of the cavities if the article is impacted in any way. Furthermore, due to the base associated with this design, it is not possible to effectively use a transparent or translucent material in the cavities, since light cannot be transmitted through the material because of the base. U.S. Pat. No. 2,841,828 to Osborn discloses an article of jewelry which includes an outer frame, an inner frame and a material which is deposited into the spaces formed within and between the inner and outer frames. Once the article is complete, it is removed from a base plate. While this article allows the effective use of transparent or translucent materials since the base plate is removed after forming, the article is still susceptible to being damaged since only the adhesion between the frames and the material holds the material in place. The fact that the article consists of a number of discrete color sections makes it prone to losing pieces of material which may be jarred from the article.

What is needed therefore is an article of jewelry which is visually appealing, durable and inexpensive to produce.

SUMMARY OF THE INVENTION

The present invention includes an article of jewelry having a cast portion including an inner frame and an outer frame, the inner and outer frames defining an aperture therebetween, and a number of spokes interconnecting the inner and outer frames. The spokes are interconnected between the inner and outer frame in such a way that the spokes span the aperture from the front portion of the inner frame to the front portion of the outer frame, while not interconnecting the rear portions of the inner and outer frames. A unitary core is disposed between the inner and outer frames and the spokes.

According to one embodiment of the invention, an article of jewelry is disclosed, comprising a first frame having a front portion and a rear portion and a second frame having a front portion and a rear portion. The first frame and the second frame cooperate to define an aperture therebetween, the aperture comprising a front portion which coincides with the front portions of the first and second frames and a rear portion which coincides with the rear portions of the first and second frames and a rear portion. The article further comprises a number of spokes connected between the front portion of the first frame and the front portion of the second frame, the spokes dividing the front portion of the aperture into a number of sub-apertures, and a unitary core disposed within the aperture. The unitary core fills the rear portion of the aperture and the front portion of the aperture, including the sub-apertures, and encompassing all but an outer surface of the spokes, thereby giving an impression that the unitary core comprises a plurality of pieces. Each of the number of spokes comprises an arch which spans the front portion of the aperture and the unitary core is formed from a translucent material. The first and second frames lie within a common plane, wherein the front portion of the inner and outer frames, the spokes, and the front portion of the aperture are disposed to one side of the common plane, and the rear portion of the inner and outer frames and the rear portion of the aperture are disposed to an opposite side of the common plane.

According to another embodiment of the invention, a method of forming an article of jewelry is disclosed. The method comprises casting a frame portion which includes a first frame having a front portion and a rear portion, a second frame having a front portion and a rear portion and a number of spokes interconnecting said front portions of said first and second frames and molding a unitary core into said frame portion between said first and second frames such that said core substantially encompasses all but an outer surface of said spokes.

Other features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION

Referring now to the figures, the jewelry article, generally indicated at 10 in FIG. 4, will now be described. The jewelry article 10 which will be described hereinbelow can form the decorative portion of earrings, necklaces, bracelets, rings, pins, or any other type of jewelry. The article 10 includes a cast portion 12, which is preferably cast from a metallic material, but may be formed from any suitable material.

Figure 1:
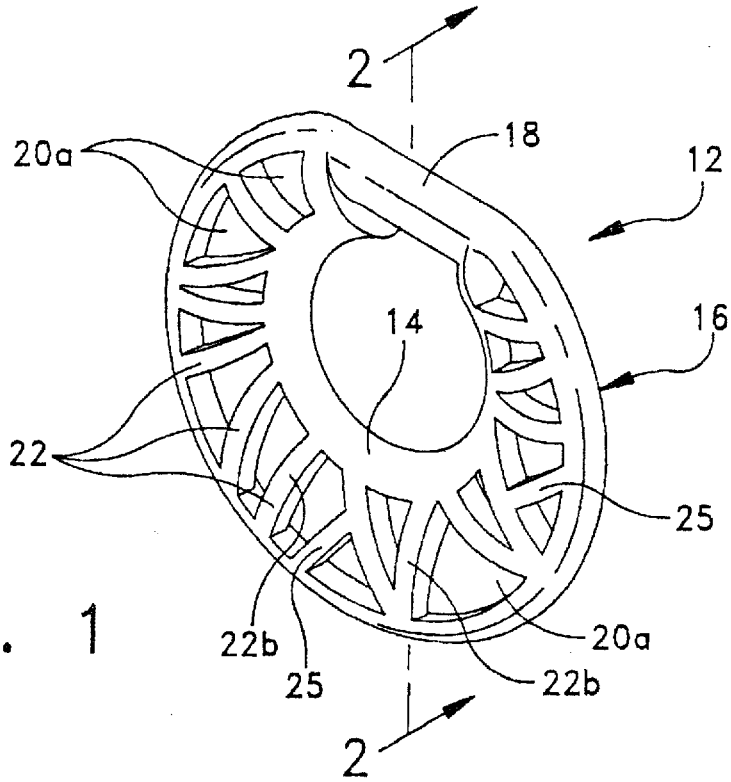
FIG. 1 is a front perspective view of the cast portion of the present invention.
Figure 2:
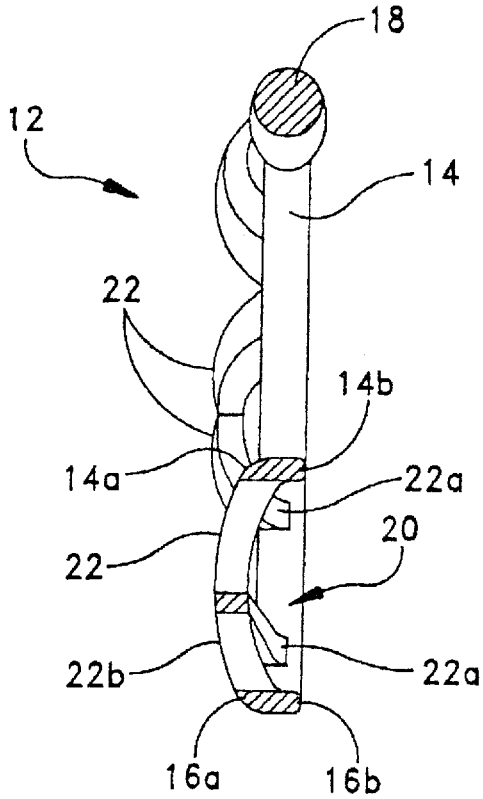
FIG. 2 is a cross-section of the cast portion of the present invention, taken along line 2—2 of FIG. 1.
Figure 3:
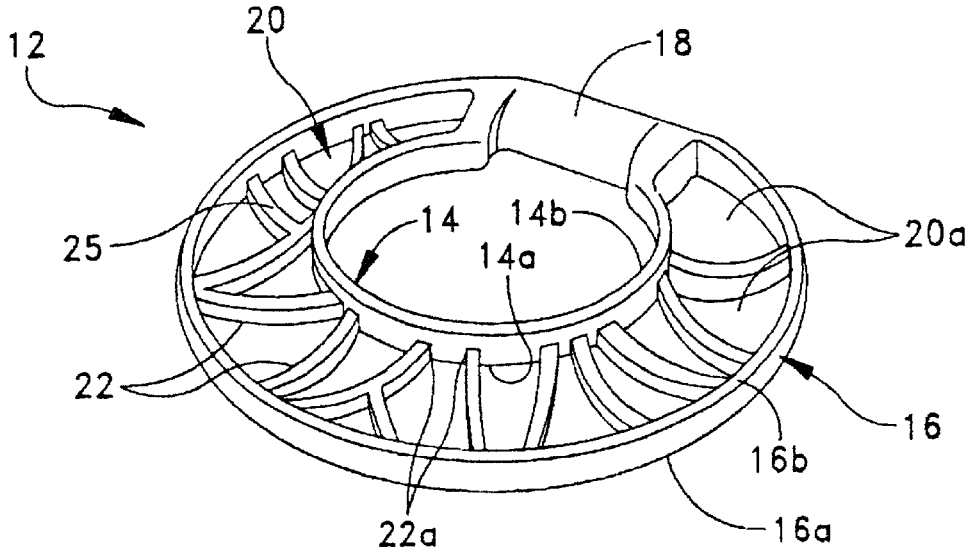
FIG. 3 is a rear perspective view of the cast portion of the present invention.

Referring to FIGS. 1–3, the cast portion 12 includes an inner frame 14 and an outer frame 16. The inner frame 14 includes a front portion 14*a* and a rear portion 14*b*, and the outer frame 16 includes a front portion 16*a* and a rear portion 16*b*. The inner frame 14 and the outer frame 16 are joined together at a common bridge portion 18 and cooperate to form an aperture 20 therebetween. A number of spokes 22 span the aperture 20 from the front portion 14*a* of the inner frame 14 to the front portion 16*a* of the outer frame 16. Spokes 22 operate to divide aperture 20 into a number of sub-apertures 20*a*. Preferably, the spokes 22 each include feet portions 22*a* which are attached to the front portion 14*a* of inner frame 14 and the front portion 16*a* of the outer frame 16 and an arch portion 22*b* which protrudes outwardly, away from the front portions 14*a* and 16*a* of the inner and outer frames 14 and 16, respectively. In order to enhance the design of the article 10, a number of spoke portions 25 may extend between the outer frame 16 and an arch portion 22*b* of a spoke 22. While not shown, it will be understood that spoke portions may also extend between the inner frame 14 and an arch portion 22*b* of a spoke 22.

Figure 4:
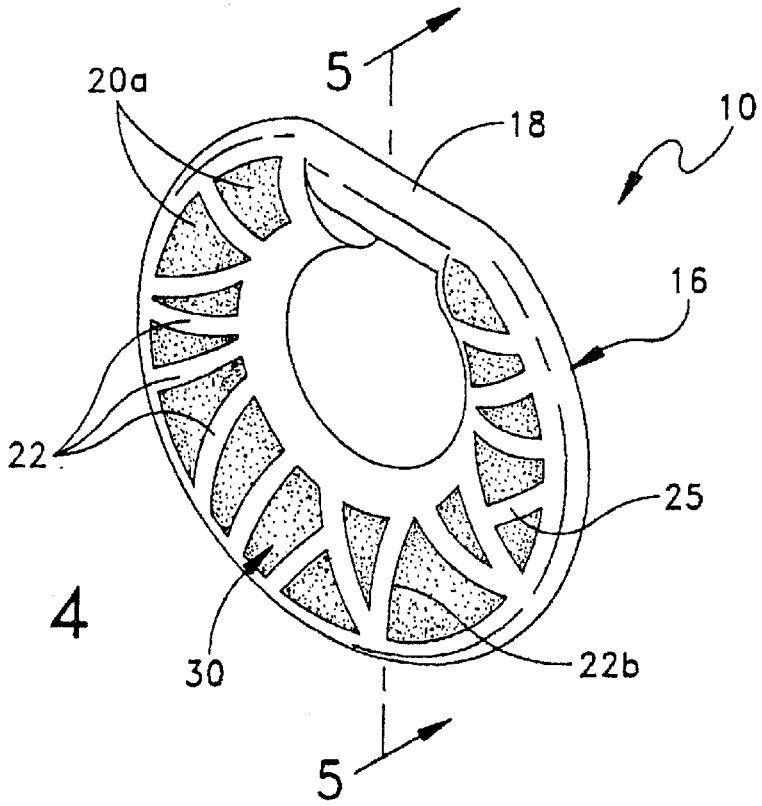
FIG. 4 is a front perspective view of the jewelry article of the present invention, showing the cast portion and the core portion.
Figure 5:
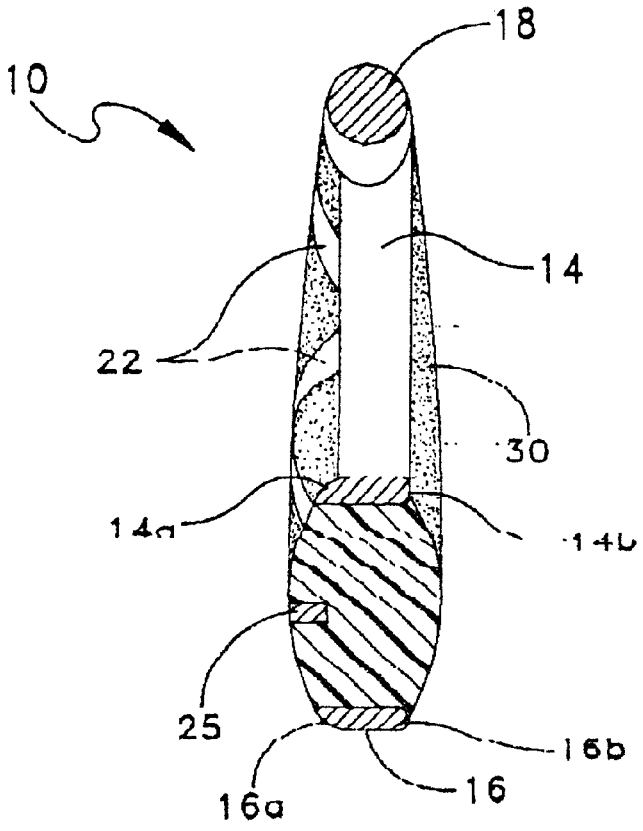
FIG. 5 is a cross-section of the cast portion of the jewelry article of the present invention, showing the cast portion and the core portion, taken along line 24-4 of FIG. 3.
Figure 6:
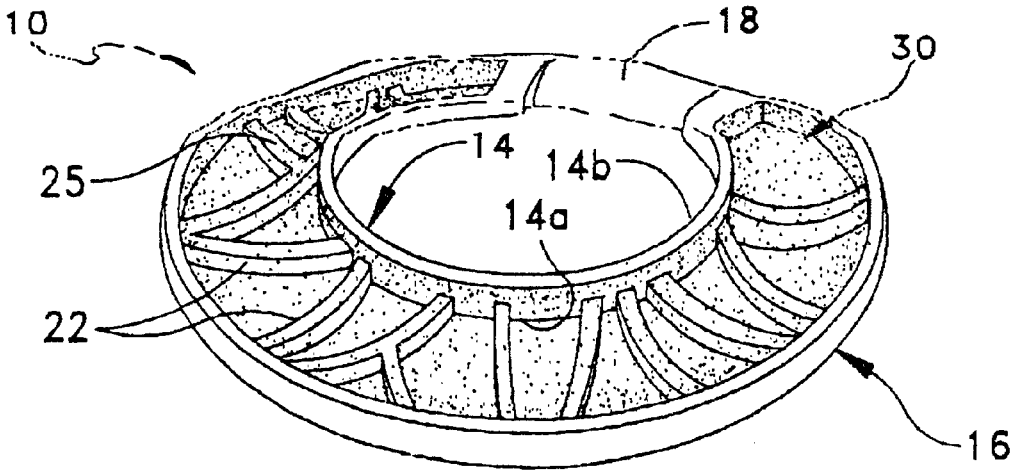
FIG. 6 is a rear perspective view of the jewelry article of the present invention.

Referring now to FIGS. 4–6, it can be seen that the article 10 also includes a core 30, which is formed from a unitary piece of material. Preferably, the material is a colored transparent or translucent material, such as plastic or glass. In order to form the core 30, the cast 12 is placed in a mold (not shown) and the material which forms the core 30 is poured into the mold in a liquid state. In the resulting article 10, the core 30 fills the aperture 20, as well as all of the sub-apertures 20*a*. As shown in FIG. 5, the core extends out of the plane of the inner frame 14 and the outer frame 16, away from the front portions 14*a* and 16*a* of the inner and outer frames 14 and 16, respectively, and away from the rear portions 14*b* and 16*b* of the inner and outer frames 14 and 16, respectively. Regarding the front of the article 10, the core 30 extends to a point wherein all but the outer surfaces of the spokes 22 and the spoke portions 25 are embedded in the core 30, such that the outer surfaces of the spokes 22 and the spoke portions 25 and the core 30 cooperate to form a smooth surface. Furthermore, the transitions from the front portions 14*a* and 16*a* of the inner frame 14 and the outer frame 16 to the core 30 are also smooth.

Regarding the rear of the article 10, the core 30 is a solid, unitary piece of material which extends away from the rear portions 14*b* and 16*b* of the inner and outer frames 14 and 16, respectively, while also effecting a smooth transition between the core 30 and the inner and outer frames 14 and 16.

Due to the fact that the spokes 22 are attached to the inner and outer frames 14 and 16 at only the front portions 14*a* and 16*a*, respectively, the entire circumferences of rear portions 14*b* and 16*b* of the inner and outer frames 14 and 16 are free to receive the core 30. This construction of the casting 12 enables core 30 to remain a single, unitary piece, while still giving the impression that the article 10 includes a number of pieces of the colored transparent or translucent material, the number being defined by the number of sub-apertures 22*a* formed by the spokes 22 and spoke portions 25. This features strengthens the article 10, since the unitary core 30 is attached to the casting 12 along several surfaces, including the inner frame 14, the outer frame 16, the spokes 22 and the spoke portions 25. Furthermore, this construction eliminates the need for a base plate for holding the core in place, which enables light to pass freely through the core 30. As a result of these features, the article 10 is more durable and visually appealing than the prior art jewelry articles.

Based on the foregoing, the present invention provides an article of jewelry which is durable, visually appealing and inexpensive to produce. The article includes a casting which includes an inner and an outer frame which cooperate to define an aperture therebetween. A number of spokes span the aperture to form a number of sub-apertures between the inner and outer frames. A core material is molded into the casting to form an article having a unitary core which appears to have a number of separate pieces set in the casting. The resulting article is both extremely durable and very visually appealing. Since the manufacturing process includes only one casting step and one molding step, the article is also inexpensive to produce.

While there is shown and described herein certain specific structure embodying the invention, it will be manifest to those skilled in the art that various modifications and rearrangements of the parts may be made without departing from the spirit and scope of the underlying inventive concept. For example, while the invention is shown and described as being annular piece, it could be formed in any shape or design which comprises opposing frames interconnected by a number of spokes. Accordingly, the inventive concept is not limited to the particular forms herein shown and described except insofar as indicated by the scope of the appended claims.

What is claimed is:

1. An article of jewelry comprising:

a first inner frame having a front portion and a rear portion;

a second outer frame having a front portion and a rear portion;

wherein said first inner frame and said second outer frame cooperate to define an aperture therebetween, said aperture comprising a front portion which coincides with said front portions of said first and second frames and a rear portion which coincides with said rear portions of said first and second frames;

a number of spokes connected between said front portion of said first inner frame and said front portion of said second outer frame, said spokes dividing only said front portion of said aperture into a number of sub-apertures; and a unitary core disposed within said aperture, said unitary core filling said rear portion of said aperture and said front portion of said aperture, including said sub-apertures, and encompassing all but an outer surface of said spokes, thereby giving an impression, when viewed from the front, that the unitary core comprises a plurality of separate segments.

2. The article of jewelry of claim 1, wherein each of said number of spokes comprises an arch which spans said front portion of said aperture.

3. The article of jewelry of claim 1, wherein said unitary core is formed from a translucent material.

4. The article of jewelry of claim 1, further comprising at least one spoke portion connected between said first frame and one of said number of spokes.

* * * * *